US010301568B2

(12) United States Patent
Mori et al.

(10) Patent No.: US 10,301,568 B2
(45) Date of Patent: May 28, 2019

(54) SLIDING SYSTEM

(71) Applicant: TOYOTA JIDOSHA KABUSHIKI KAISHA, Toyota-shi, Aichi-ken (JP)

(72) Inventors: Hiroyuki Mori, Nagakute (JP); Mamoru Tohyama, Nagakute (JP); Masaru Okuyama, Nagakute (JP); Keiji Hayashi, Nagoya (JP); Naoya Ikeda, Nisshin (JP)

(73) Assignee: TOYOTA JIDOSHA KABUSHIKI KAISHA, Toyota-shi, Aichi-ken (JP)

( * ) Notice: Subject to any disclaimer, the term of this patent is extended or adjusted under 35 U.S.C. 154(b) by 0 days.

(21) Appl. No.: 15/417,452

(22) Filed: Jan. 27, 2017

(65) Prior Publication Data

US 2017/0247625 A1 Aug. 31, 2017

(30) Foreign Application Priority Data

Feb. 25, 2016 (JP) ..... 2016-034900

(51) Int. Cl.
*C10M 125/08* (2006.01)
*C10M 125/22* (2006.01)
*C10M 135/18* (2006.01)

(52) U.S. Cl.
CPC ..... *C10M 125/22* (2013.01); *C10M 125/08* (2013.01); *C10M 135/18* (2013.01);
(Continued)

(58) Field of Classification Search
CPC C10M 125/22; C10M 125/08; C10M 135/18; C10M 2201/061; C10M 2201/066;
(Continued)

(56) References Cited

U.S. PATENT DOCUMENTS 6,071,324 A * 6/2000 Laul ..... C22C 32/0052 148/410
6,500,786 B1 * 12/2002 Hartley ..... C10M 141/10 508/365

(Continued)

FOREIGN PATENT DOCUMENTS

EP 1 462 508 B1 8/2009
EP 2966152 A1 1/2016

(Continued)

OTHER PUBLICATIONS

"Tribology of Miniature Systems", Z. Rymuza, Ed., Elsevier, 1989, pp. 269-301.*

(Continued)

*Primary Examiner* — James C Goloboy
(74) *Attorney, Agent, or Firm* — Sughrue Mion, PLLC

(57) ABSTRACT

[Technical Problem]
An object is to provide a sliding system which can achieve both the reduced friction and the enhanced wear resistance by means of a novel combination of a sliding film and a lubricant oil.
[Solution to Problem]
The sliding system of the present invention comprises: a pair of sliding members having sliding surfaces that can relatively move while facing each other; and a lubricant oil interposed between the sliding surfaces facing each other. At least one of the sliding surfaces comprises a coating surface of a crystalline chromium carbide film. The lubricant oil contains an oil-soluble molybdenum compound that has a chemical structure of a trinuclear of Mo. When the chromium carbide film as a whole is 100 at %, the chromium carbide film contains 40-75 at % of Cr. The chromium carbide film in contact with the lubricant oil containing a Mo-trinuclear appears to react with the Mo-trinuclear adsorbed during the sliding to generate a layered structural
(Continued)

body (boundary film) similar to $MoS_2$ on the surface, thereby developing a considerably low friction property.

8 Claims, 4 Drawing Sheets

(52) U.S. Cl.
CPC . *C10M 2201/061* (2013.01); *C10M 2201/066* (2013.01); *C10M 2219/068* (2013.01); *C10N 2210/06* (2013.01); *C10N 2230/06* (2013.01); *C10N 2270/00* (2013.01); *C10N 2280/00* (2013.01)

(58) Field of Classification Search
CPC ..... C10N 2210/06; C10N 2230/06; C10N 2270/00; C10N 2280/00
See application file for complete search history.

(56) References Cited

U.S. PATENT DOCUMENTS

| | | | | |
|---|---|---|---|---|
| 2005/0119136 | A1 | | 6/2005 | Castle |
| 2006/0111253 | A1 | | 5/2006 | Harris et al. |
| 2014/0179572 | A1 | * | 6/2014 | Loper ..... C10M 133/16 508/287 |
| 2015/0344811 | A1 | | 12/2015 | Strong et al. |

FOREIGN PATENT DOCUMENTS

| | | | | |
|---|---|---|---|---|
| JP | 2004204311 | A | * | 7/2004 |
| JP | 2004-339486 | A | | 12/2004 |
| JP | 3728740 | B2 | | 10/2005 |
| JP | 2006-002221 | A | | 1/2006 |
| JP | 2007-146090 | A | | 6/2007 |
| JP | 5050048 | B2 | | 7/2012 |
| JP | 2015-108181 | A | | 6/2015 |
| JP | 2015108181 | A | * | 6/2015 |
| JP | 2015-227452 | A | | 12/2015 |
| WO | 2007/115030 | A1 | | 10/2007 |

OTHER PUBLICATIONS

English-language machine translation of JP 2004-204311 A.*
Communication dated Dec. 12, 2017 from the Japanese Patent Office in counterpart Application No. 2016-034900.
Office Action issued in German Patent Application 10 2016 119 815.3.

* cited by examiner

R = hydrocarbyl

Mo−Trinuclear

SLIDING SYSTEM

TECHNICAL FIELD

The present invention relates to a sliding system which can achieve both the reduced friction and the enhanced wear resistance by means of a combination of a chromium carbide film and a lubricant oil that contains an oil-soluble molybdenum compound having a specific chemical structure.

BACKGROUND ART

Various machines are provided with sliding members that relatively move while being slidably in contact with each other. In a system having such sliding members (referred to as a "sliding system" in the present description, e.g., a sliding machine), the friction coefficient between the sliding surfaces may be reduced thereby to reduce the sliding resistance and it is possible to enhance the performance and reduce the operational energy. In addition, the durability, reliability and other necessary properties of the sliding system can be improved not only by reducing the friction but also by enhancing the wear resistance between the sliding surfaces.

Incidentally, the sliding properties such as friction coefficient and wear resistance are different depending on the surface condition of each sliding surface during the operation and the lubrication state between the sliding surfaces. In order to enhance the sliding properties, various studies have heretofore been made to modify the sliding surfaces and improve the lubricant (lubricant oil) which is supplied between the sliding surfaces. Descriptions relevant to the above studies are found in Patent Literature (PTL) below, for example.

CITATION LIST

Patent Literature

[PTL 1]
JP2004-339486A (EP1462508B 1)
[PTL 2]
JP3728740B (JP8-296030A)
[PTL 3]
JP5050048B

SUMMARY OF INVENTION

Technical Problem

PTL 1 proposes a combination of an ordinary DLC film and a lubricant, wherein the DLC film is free from metal elements and other additive elements and the lubricant is obtained by adding 550 ppm, as an amount of Mo, of molybdenum dithiocarbamate to a base oil. PTL 1, however, merely describes that the combination can reduce the friction coefficient, and nothing in PTL 2 reveals the mechanism, wear resistance and other details. Moreover, the friction coefficient obtained by the combination is about 0.1 at the most and the reduction of friction coefficient may thus be insufficient.

PTL 2 describes providing an outer circumferential sliding surface of a piston ring for internal-combustion engines with an ion plating film of a mixture of CrN-type chromium nitride and $Cr_2N$-type chromium nitride, wherein the crystal orientation ratio of the CrN and the $Cr_2N$ is optimized thereby to improve the wear resistance, the anti-scuffing ability and other properties of piston rings. However, PTL 2 merely describes performing a wear resistance test and other tests using an ordinary engine oil as the lubricant oil and nothing in PTL 2 describes or suggests the influence, etc., that the above film affects the friction coefficient between the sliding surfaces.

PTL 3 describes a deposited material of crystalline chromium (so-called Cr plating) that contains carbon, nitrogen and sulfur, but nothing in PTL 3 specifically discloses the sliding properties.

The present invention has been created in view of such circumstances and an object of the present invention is to provide a sliding system which can achieve the reduced friction and the enhanced wear resistance by means of a novel combination of a sliding film and a lubricant oil.

Solution to Problem

As a result of intensive studies to achieve the above object, the present inventors have discovered that a novel combination of a chromium carbide film and a lubricant oil that contains an oil-soluble molybdenum compound having a specific chemical structure can drastically reduce the friction coefficient between sliding surfaces and can also allow excellent wear resistance to be obtained. Developing this achievement, the present inventors have accomplished the present invention, as will be described hereinafter.

«Sliding System»

(1) The sliding system of the present invention comprises: a pair of sliding members having sliding surfaces that can relatively move while facing each other; and a lubricant oil interposed between the sliding surfaces facing each other. The sliding system has features as below. At least one of the sliding surfaces comprises a coating surface of a crystalline chromium carbide film. The lubricant oil contains an oil-soluble molybdenum compound that has a chemical structure of a trinuclear of Mo. When the chromium carbide film as a whole is 100 at %, the chromium carbide film contains 40-75 at % of Cr.

(2) According to the sliding system of the present invention, the sliding surface coated with a chromium carbide film and the lubricant oil which contains an oil-soluble molybdenum compound having a specific chemical structure are combined thereby to achieve at high levels both the reduced friction coefficient between the sliding surfaces and the improved wear resistance. Specifically, a low-friction property can be developed such that the friction coefficient is 0.06 or less in an embodiment, 0.05 or less in another embodiment, and 0.04 or less in a further embodiment. Moreover, the sliding surface of a chromium carbide film can have a wear depth, which is indicative of the wear resistance, of ¼ or less in an embodiment and ⅕ or less in another embodiment, for example, compared with that of a sliding surface of a steel material.

Such a sliding system of the present invention is particularly suitable for machines, such as in a drive system, which are operated for a long time under severe conditions from a boundary lubrication (friction) condition to a mixed lubrication (friction) condition. Thus, the present invention can greatly contribute to reduction of fuel consumption, performance upgrade and other benefits while ensuring the reliability when the sliding system is used, for example, for an engine or a drive system unit such as transmission.

(3) Although the mechanism is not necessarily sure that the combination of a chromium carbide film and a lubricant oil according to the present invention develops excellent sliding properties, the present inventors consider under present circumstances as follows.

When the sliding system (specifically a sliding machine) of the present invention is operated, the oil-soluble molybdenum compound, which is contained in the lubricant oil and comprises a trinuclear of Mo (and which may be referred to as a "Mo-trinuclear compound" or simply as a "Mo-trinuclear"), adsorbs onto the sliding surface of the chromium carbide film. This adsorption can occur even when the content of the Mo-trinuclear in the lubricant oil is very small. Although the reason is not sure, after the sliding system is operated (during the sliding), a molybdenum sulfide compound of a layered structure similar to $MoS_2$ is generated on the sliding surface (chromium carbide film) to which the Mo-trinuclear has adsorbed, and an excellent low shear property is thereby developed. This appears to allow the friction coefficient to be drastically reduced on the sliding surface of the chromium carbide film even under a wide variety of operational situations including the boundary friction. As will be understood, a part of the molybdenum sulfide compound to be generated may be generated not only from the Mo-trinuclear but also from elements (such as Mo and S) as the supply sources contained in other additives which have a competitive adsorption relationship with the Mo-trinuclear.

The chromium carbide film according to the present invention is composed of a crystalline material, which is ordinarily harder than an amorphous film (DLC film) and a base material (e.g., steel material) and less likely to transfer and adhere to the sliding surface of the counterpart sliding member. The sliding system of the present invention is thus considered to exhibit high wear resistance in the presence of the above-described lubricant oil.

When the lubricant oil contains Ca, it also adsorbs onto the sliding surface. This Ca contributes to an increased thickness of a boundary film that is generated on the chromium carbide film. It can be considered that the generation of a thick boundary film mitigates the aggressiveness to the chromium carbide film during the sliding and the wear resistance is further improved. The lubricant oil may often contain Ca to a greater or lesser extent. For example, engine oil may often contain Ca as an element for an additive or depurant, such as overbased calcium sulfonate, which forms a reactive film.

«Others»

(1) The Mo-trinuclear according to the present invention is not limited in its functional groups bonded to the ends, molecular weight and other properties, but may preferably have a molecular structural skeleton of at least one of $Mo_3S_7$ or $Mo_3S_8$ (in particular $Mo_3S_7$). Just for reference, FIG. 5 illustrates an example of the molybdenum sulfide compound of $Mo_3S_7$. In the figure, R represents a hydrocarbyl group.

The Mo-trinuclear according to the present invention may react to adsorb to the sliding surface, thereby forming a molybdenum sulfide compound having a certain chemical structure, such as $Mo_3S_7$, $Mo_3S_8$ and $Mo_2S_6$ in addition to the above-described $MoS_2$, on the sliding surface. Such a molybdenum sulfide compound can also exhibit a low shear property between the sliding surfaces based on the layered structure to contribute to the reduction of the friction coefficient.

(2) The chromium carbide film according to the present invention primarily comprises Cr and C, but may further contain, as additional elements, doped elements (such as O and N) which do not inhibit the low-friction property or which improve the low-friction property. Cr and C in the chromium carbide film may exist not only as CrC but also as $Cr_7C_3$ or $Cr_3C_2$. In the present description, the chromium carbide (film) may be denoted as CrC (film), but it does not necessarily mean that the compound or the crystal structure is specified to a single body of CrC. In consideration of the above, it is preferred that, when the chromium carbide film as a whole is 100 at % (referred simply to as "%"), the chromium carbide film according to the present invention contains 40-75% of Cr and 25-60% of C in an embodiment, 45-70% of Cr and 30-55% of C in another embodiment, and 50-65% of Cr and 35-50% of C in a further embodiment. If the content of Cr is unduly small, amorphous carbon is likely to be generated and the crystalline chromium carbide film cannot be obtained. If the content of Cr is unduly large, the generation of a chromium carbide film itself will be difficult.

When the chromium carbide film contains doped elements and the like, it is preferred that the chromium carbide film contains 1-10% in an embodiment and about 3-7% in another embodiment of other elements than Cr and C. The film composition as referred to in the present description is specified using an electron probe microanalyzer (EPMA). X-ray diffraction or Raman spectroscopic analysis is used to confirm that the chromium carbide film according to the present invention is crystalline.

(3) The "sliding system" as referred to in the present invention is sufficient as long as it comprises sliding members and lubricant oil, and may not only be a completed product as a machine but may also be a combination of mechanical elements that constitute a part of the product, etc. The sliding system of the present invention may also be referred to as a sliding structure, a sliding machine (e.g., engine, transmission), or other appropriate term.

The coating surface of the chromium carbide film according to the present invention may be formed as a sliding surface of at least one of the sliding members which relatively move while facing each other. As will be understood, it is more preferred that both of the sliding surfaces facing each other are the coating surfaces of the chromium carbide films.

(4) Unless otherwise stated, a numerical range "x to y" as referred to in the present description includes the lower limit value x and the upper limit value y. Any numerical value included in various numerical values or numerical ranges described in the present description may be appropriately selected or extracted as a new lower limit value or upper limit value, and any numerical range such as "a to b" may thereby be newly provided using such a new lower limit value or upper limit value.

DESCRIPTION OF EMBODIMENTS

Figure 1:
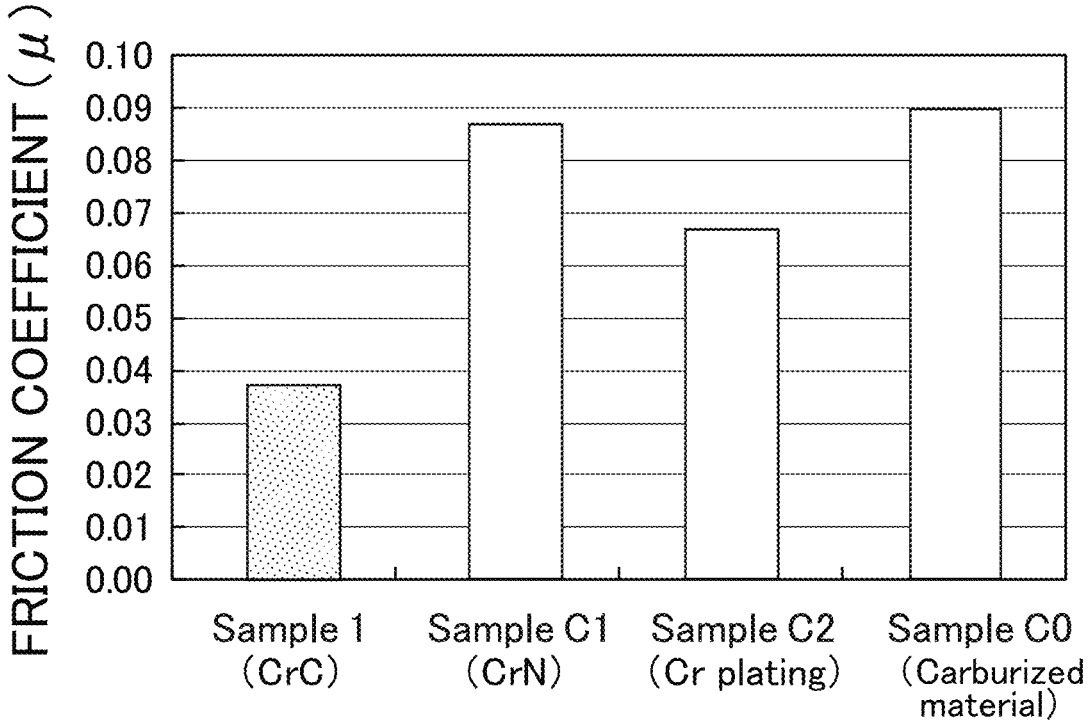
FIG. 1 is a bar graph comparing friction coefficients of the samples.

One or more features freely selected from the present description may be added to the above-described features of the present invention. The contents described in the present description may be applied not only to the sliding system as a whole according to the present invention but also to sliding members and lubricant oil which constitute the sliding system. Moreover, in a certain case (when there is a situation where it is impossible or utterly impractical to directly specify a "product" by its structure or characteristics (impossible/impractical circumstances) or the like), features regarding a production process can also be features regarding the "product" when understood as those in a product-by-process. Which embodiment is the best or not is different in accordance with objectives, required performance and other factors.

«Lubricant Oil»

The lubricant oil according to the present invention is not limited in the type of a base oil and presence or absence of other additives, etc., provided that the lubricant oil contains a Mo-trinuclear. In general, lubricant oil such as engine oil contains various additives including S, P, Zn, Ca, Mg, Na, Ba, or Cu, etc. Even in such lubricant oil, the Mo-trinuclear according to the present invention preferentially acts on the sliding surface (coating surface) coated with the chromium carbide film and generates a molybdenum sulfide compound (such as $MoS_2$, $Mo_3S_7$, $Mo_3S_8$ and $Mo_2S_6$) which can reduce the friction coefficient.

The lubricant oil according to the present invention may contain other Mo-based compounds (such as MoDTC) than the Mo-trinuclear, but the total amount of the contained Mo may preferably be small because Mo is a kind of rare metal.

Unduly small amount of the Mo-trinuclear makes it difficult to exhibit the effect as the above, whereas unduly large amount of the Mo-trinuclear may not cause any problem. As described above, however, the usage of Mo may preferably be small. It is therefore preferred that the Mo-trinuclear according to the present invention has a mass ratio of Mo to the lubricant oil as a whole of 25-900 ppm in an embodiment, 50-800 ppm in another embodiment, 60-500 ppm in still another embodiment, and 70-200 ppm in a further embodiment. When the mass ratio of Mo to the lubricant oil as a whole is represented in ppm, it will be denoted by "ppmMo." Note that, even when the lubricant oil contains other Mo-based compounds and the like than the Mo-trinuclear, the upper limit of the total amount of Mo may preferably be 1,000 ppmMo in an embodiment and 400 ppmMo in another embodiment to the lubricant oil as a whole.

«Chromium Carbide Film»

Method of forming the chromium carbide film according to the present invention is not limited. For example, a desired chromium carbide film can be efficiently formed using, for example, a physical vapor deposition (PVD) method such as a sputtering (SP) method (in particular, an unbalanced magnetron sputtering (UBMS) method) and arc ion plating (AIP) method.

The SP method is a method in which a voltage is applied between a target at the cathode side and a surface to be coated at the anode side, and inert gas atom ions generated due to glow discharge are caused to collide with the target surface so that particles (atoms/molecules) released from the target are deposited to form a film on the surface to be coated. In an embodiment of the present invention, the chromium carbide film can be formed on the sliding surface, for example, by performing the sputtering using metal Cr as the target and Ar gas as the inert gas, forming a Cr intermediate layer from the released Cr atoms (ions), and thereafter reacting the intermediate layer with a hydrocarbon gas (such as $C_2H_2$ gas) introduced.

The AIP method is a method in which a metal target (vaporization source) is used as the cathode to cause arc discharge, for example, in a reactive gas (process gas) so that metal ions generated from the metal target react with the reactive gas particles to form a dense film on a surface to be coated to which a bias voltage (negative voltage) is applied. In an embodiment of the present invention, for example, the target may be metal Cr and the reactive gas may be a hydrocarbon gas (such as $C_2H_2$ gas).

When forming a chromium carbide film that contains doped elements in addition to Cr and C, a target or a reactive gas that contains the doping elements may be used. The composition, structure and other properties of the chromium carbide film can be controlled by adjusting the components of the target and/or the reactive gas and/or adjusting the gas pressure of the reactive gas.

«Use Application»

The sliding members according to the present invention are not limited in the type, form, sliding scheme and other features, provided that the sliding members have sliding surfaces that relatively move while the lubricant oil is interposed therebetween. The sliding system provided with such sliding members is also not limited in its specific form, scheme, use application, etc. and can be widely applied to various machines, apparatuses and the like which require reduction of the sliding resistance and reduction of the machine loss due to sliding while ensuring the reliability. For example, the sliding system of the present invention may preferably be utilized for an engine unit and drive system unit (such as transmission) for vehicles such as cars. Examples of the sliding members that constitute such a sliding system include: components, such as a cam, valve lifter (e.g., the sliding surface is a contacting surface with a cam), follower, shim, valve and valve guide, which constitute a dynamic valve system; piston (e.g., the sliding surface is a piston skirt); piston ring; piston pin; crankshaft; gear; rotor; rotor housing; valve; valve guide; and pump.

EXAMPLES

«Overview»

A plurality of materials under test (sliding members) with various types of sliding surfaces was combined with a lubricant oil containing a Mo-trinuclear (oil-soluble molybdenum compound) (referred to as a "compounded oil") to perform a sliding test (block-on-ring friction test). The present invention will be more specifically described with reference to the results of the friction test, etc.

«Production of Samples»

(1) Base Material

A plurality of block-like base materials (6.3 mm×15.7 mm×10.1 mm) was prepared, each comprising a quenched steel material (JIS SCM420). A surface (surface to be coated) of each base material was mirror-finished (surface roughness: Ra 0.08 micrometers).

There were prepared samples obtained by coating surfaces of the base materials with a chromium carbide film (referred simply to as "CrC (film),"/Sample 1), a chromium nitride film (referred simply to as "CrN (film),"/Sample C1) and a chromium plating film (referred simply to as "Cr plating,"/Sample C2), and a sample obtained by causing a surface of the base material to be a carburized surface (hardness: HV 700, surface roughness: Ra 0.08 micrometers) without forming a film (referred simply to as a "carburized material,"/Sample C0).

(2) Film Formation

The CrC film was formed using an unbalanced magnetron sputtering apparatus. Specifically, after the chamber was preliminarily evacuated, a pure Cr target was sputtered with Ar gas to form a Cr intermediate layer on the base material surface. Subsequently, $C_2H_2$ gas was further introduced therein to synthesize a CrC film.

The CrN film was synthesized by sputtering a target of pure Cr with Ar gas using the same sputtering apparatus to cause the released Cr atoms (ions) to react with $N_2$ gas.

Film formation of the Cr plating was performed in a chromium acid-sodium silicofluoride-sulfuric acid bath at a bath temperature of 50-60 degrees C. with a current density of 30-60 A/dm$^2$.

«Measurement before Sliding Test»

(1) Film Composition

Before the sliding test, the film composition of each sample was quantified using an EPMA (JXA-8200 available from JEOL Ltd). The results are listed together in Table 1. The base material composition (unit: mass %) of the steel material (SCM420) includes 0.9-1.2% Cr, 0.17-0.23% C, 0.15-0.35% Si, 0.60-0.90% Mn, and the balance Fe with incidental impurities.

(2) Film Structure

The CrC film was analyzed using a Raman spectrometer (NRS-3200 available from JASCO Corporation). This analysis was performed not only before the sliding test but also after the sliding test. For comparison, a commercially-available DLC film (available from Kobe Steel, Ltd.) and a standard product of $MoS_2$ were also analyzed. The Raman spectra thereof are illustrated together in FIG. 3.

The CrC film was analyzed using X-ray diffraction and it was confirmed from the profile that the CrC film comprises $Cr_7C_3$ crystals and $Cr_3C_2$ crystals. The same was confirmed also from electron beam diffraction using a transmission electron microscope (TEM).

Figure 3:
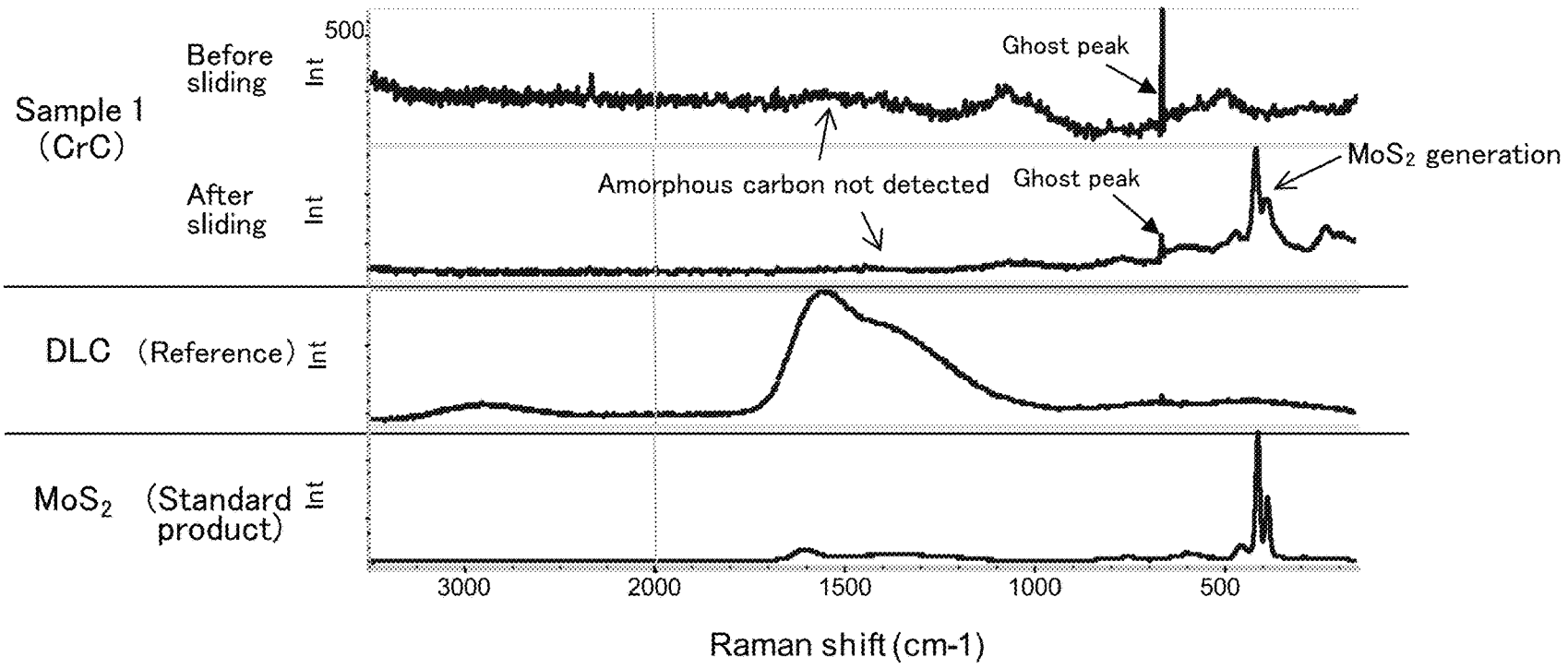
FIG. 3 is a set of Raman spectra of the samples.

The CrC film being crystalline is also found from the Raman spectrum of the CrC film illustrated in FIG. 3 in which a peak as appearing in that of the amorphous DLC film (amorphous material) is not observed.

«Lubricant Oil»

An engine oil (motor oil SN 0W-20 available from TOYOTA MOTOR CORPORATION) having a viscosity grade of 0W-20 and corresponding to ILSAC GF-5 standard was prepared as the lubricant oil to be used for the friction test. This engine oil is free from molybdenum dithiocarbamate (MoDTC).

For this engine oil, a Mo trinuclear denoted as "Trinuclear" in the disclosed documentation "Molybdenum Additive Technology for Engine Oil Applications" available from Infineum International Limited (which may be referred simply to as a "Mo-trinuclear") was additionally compounded so that the Mo content in the oil as a whole would be 80 ppmMo equivalent. The components of this compounded oil are listed in Table 2.

«Sliding Test»

(1) Friction Coefficient

Block-on-ring friction test (referred simply to as a "friction test") was performed for a combination of each material under test and the compounded oil to measure the friction coefficient (mu) of each sliding surface. A bar graph comparing the friction coefficients thus obtained is illustrated in FIG. 1.

The friction test was performed using each material under test as a block test piece having a sliding surface width of 6.3 mm and using a standard test piece S-10 (hardness of HV 800 and surface roughness of Rzjis 1.7-2.0 micrometers) of a carburized steel material (AISI4620) available from FALEX CORPORATION as a ring test piece (outer diameter of 35 mm and width of 8.8 mm). The friction test was performed for 30 minutes under the conditions of a test load of 133 N (Hertz contact pressure: 210 MPa), a sliding speed of 0.3 m/s and an oil temperature of 80 degrees C. (fixed), and the average value of mu during one minute immediately before completion of the test was determined as the friction coefficient.

(2) Wear Depth of Sliding Surface

Figure 2:
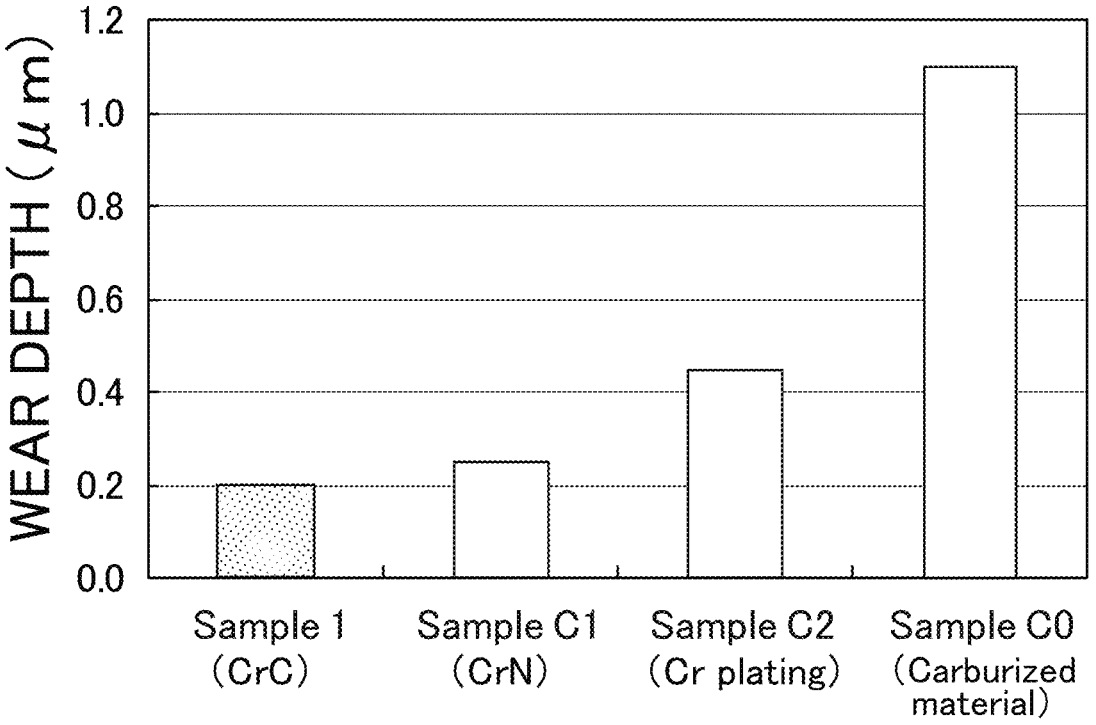
FIG. 2 is a bar graph comparing wear depths of the samples.

The surface profile (roughness) of each sliding surface after the friction test was measured using a white light interferometric non-contact surface profiler (NewView 5000 available from Zygo Corporation). A bar graph comparing the wear depths thus obtained is illustrated in FIG. 2. Each film thickness before the test, specified from a friction trace using Calotest available from CSM Instruments SA, was 1-2 micrometers (CrC film: 1-1.5 micrometers).

(3) Analysis of Sliding Surface

Each sliding surface after the friction test was analyzed using X-ray photoelectron spectroscopy (XPS). The ratios (at %) of elements detected on each sliding surface are listed together in Table 1.

Figure 4:
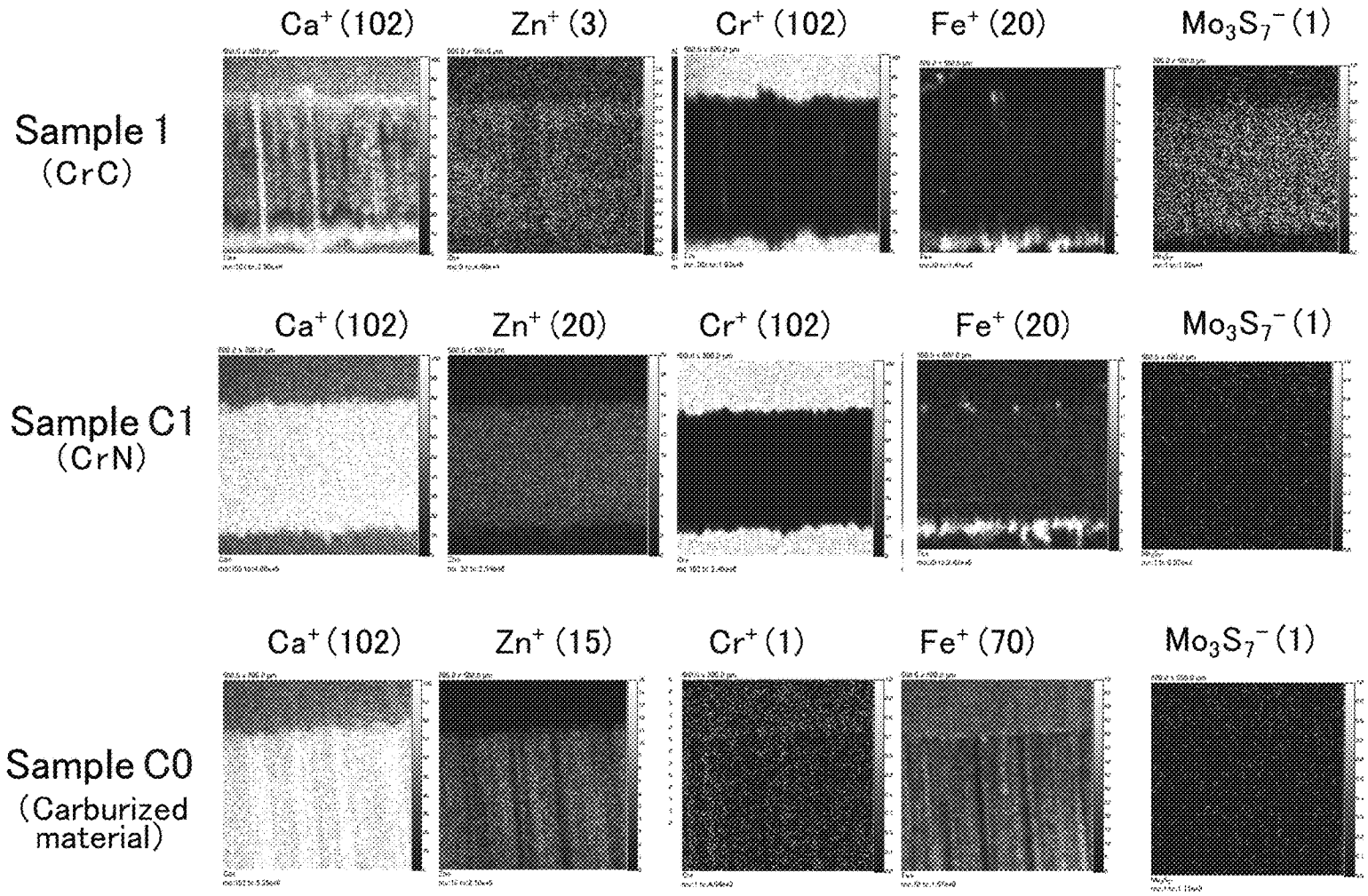
FIG. 4 is a set of surface analysis results by TOF-SIMS of the samples.
Figure 5:
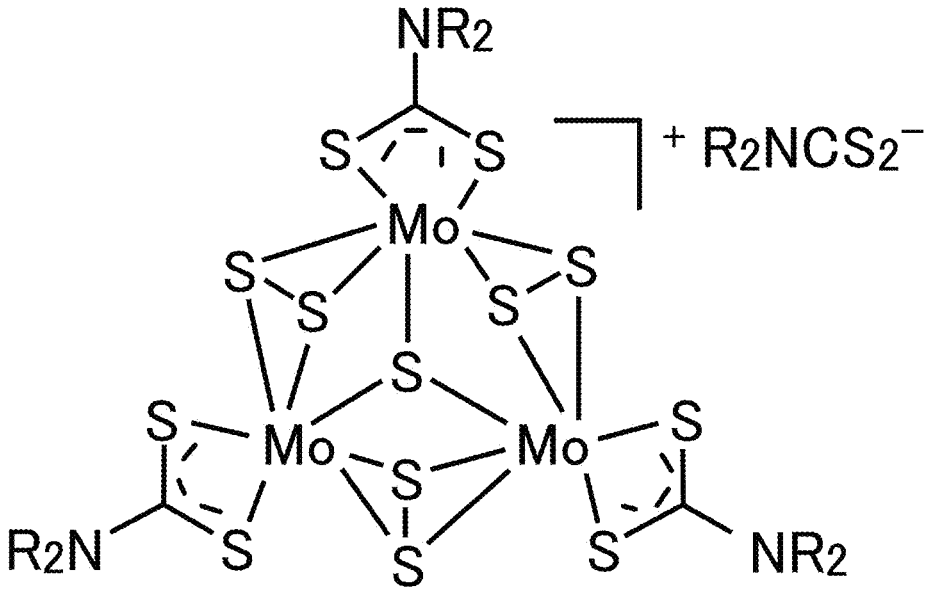
FIG. 5 is a molecular structure diagram illustrating an example of Mo-trinuclear according to the present invention.

In addition, each sliding surface after the friction test was measured using time-of-flight secondary ion mass spectrometry (TOF-SIMS/a TOF-SIMS apparatus available from Ion-Tof). During this measurement, high resolution spectrum measurement was carried out for a region of 100 micrometers×100 micrometers using a $Bi^+$ beam of 30 keV as the primary ions. FIG. 4 illustrates the results of analysis of each element on the sliding surfaces, obtained in the above.

«Evaluation»

(1) Friction Coefficient

As apparent from FIG. 1, when the lubricant oil containing a Mo-trinuclear is used, the friction coefficients of the Cr-based films are lower than that of the carburized material. In particular, the friction coefficient of the CrC film is significantly lower than that of the carburized material by 60% or more.

To research the influence of additives contained in the lubricant oil, an additive-free base oil (YUBASE8 Group III base oil) was prepared and the above-described friction test was performed in the same manner. In this friction test, the friction coefficient of the CrC film was 0.09. When the above engine oil compounded with no Mo-trinuclear was used, the friction coefficient was 0.08. It thus became apparent from the above results that the combination of the lubricant oil containing a Mo-trinuclear and the CrC film significantly reduces the friction coefficient.

(2) Wear Resistance

As apparent from FIG. 2, when the lubricant oil containing a Mo-trinuclear is used, the wear depths of the Cr-based films are lower than that of the carburized material. In particular, the wear depth of the CrC film is significantly reduced to one fifth or less that of the carburized material. It thus became apparent from the above results that the combination of the lubricant oil containing a Mo-trinuclear and the CrC film allows both the reduced friction and the enhanced wear resistance at high levels.

(3) Consideration

The reason that the combination of the CrC film and the lubricant oil containing a Mo-trinuclear allows both the reduced friction and the enhanced wear resistance at high levels is presumed as below.

As found from the results of analysis using XPS for observing the sliding surfaces after the sliding test (see Table 1), the CrC film shows less adsorption of Zn, P and N to the sliding surface and greater adsorption of Ca, S and Mo to the sliding surface than the results of the carburized material and CrN film.

Also from the results of analysis using the TOF-SIMS (see FIG. 4), it is found not only that the results are similar to those using the XPS but also that $Mo_3S_7^-$ fragments, which are not detected in the carburized material and CrN film, are detected in the CrC film. This originates from the Mo-trinuclear. It is thus presumed that the CrC film acts with the Mo-trinuclear thereby to cause a large amount of Mo and S to be detected on the sliding surface.

Moreover, as found from the results of Raman spectroscopic analysis (see FIG. 3), a similar spectrum to that of $MoS_2$, which was not detected before the sliding test, was detected on the CrC film (sliding surface) after the sliding test. This leads to the following presumption. The CrC film in contact with the lubricant oil containing a Mo-trinuclear reacts with the Mo-trinuclear adsorbed during the sliding to generate a layered structural body (boundary film) similar to $MoS_2$ on the surface. It is thus presumed that the above reaction allows the CrC film to develop an excellent low shear property under the presence of the lubricant oil containing a Mo-trinuclear and a considerably low friction coefficient is exhibited.

It is also presumed that the reason that the CrC film cooperates with the lubricant oil containing a Mo-trinuclear thereby to develop high wear resistance is not only associated with the above-described factors of developing low friction but also is largely caused by the formation of a thick boundary film because the CrC film is crystalline and hard and the adsorption amount of Ca other than Mo and S is large.

When, in the CrC film, the content of Cr was less than 40% (in particular, 30% or less), the CrC film was rather a film in which chromium carbide is dispersed in a matrix of amorphous carbon (DLC) (referred simply to as a "DLC matrix"), and high wear resistance as in the CrC film according to the present invention was not able to be obtained. The film of such a DLC matrix appears to be soft and deteriorated in the wear resistance due to the influence of additives (such as Mo-DTC) contained in the lubricant oil. The DLC matrix is confirmed by the Raman spectroscopic analysis in which an amorphous spectrum specific to DLC is obtained (see FIG. 3).

The invention claimed is:

1. A sliding system comprising:

a pair of sliding members having sliding surfaces that can relatively move while facing each other; and a lubricant oil interposed between the sliding surfaces facing each other, wherein at least one of the sliding surfaces comprises a coating surface of a crystalline chromium carbide film;

wherein the lubricant oil contains an oil-soluble trinuclear molybdenum (Mo) compound, wherein, when the chromium carbide film as a whole is 100 at %, the chromium carbide film contains 50-75 at % of Cr, wherein the chromium carbide film contains $Cr_7C_3$ and $Cr_3C_2$, and wherein a thickness of the chromium carbide film is 1 to 1.5 μm.

2. The sliding system as recited in claim 1, wherein the trinuclear Mo compound has a molecular structural skeleton of at least one of $Mo_3S_7$ or $Mo_3S_8$.

3. The sliding system as recited in claim 1, wherein the lubricant oil contains the trinuclear Mo compound with a mass ratio of Mo to the lubricant oil as a whole of 25-900 ppm.

4. The sliding system as recited in claim 1, wherein $MoS_2$ is generated on the coating surface during sliding.

5. A sliding system comprising:

a pair of sliding members having sliding surfaces that can relatively move while facing each other; and a lubricant oil interposed between the sliding surfaces facing each other, wherein at least one of the sliding surfaces comprises a coating surface of a crystalline chromium carbide film;

wherein the lubricant oil contains an oil-soluble trinuclear molybdenum (Mo) compound, wherein, when the chromium carbide film as a whole is 100 at %, the chromium carbide film contains 50-75 at % of Cr, wherein the chromium carbide film contains $Cr_7C_3$ and $Cr_3C_2$, wherein the coating surface is a single-layer of the crystalline chromium carbide film, and wherein a thickness of the single-layer of the chromium carbide film is 1 to 1.5 μm.

6. The sliding system as recited in claim 5, wherein the trinuclear Mo compound has a molecular structural skeleton of at least one of $Mo_3S_7$ or $Mo_3S_8$.

TABLE 1

| Sample | | Composition of film (at %) | | | Results of analysis of sliding surface after friction test | | | | | | | | | |
|---|---|---|---|---|---|---|---|---|---|---|---|---|---|---|
| No. | Name | Cr | C | N | Fe | Cr | C | O | N | Ca | Zn | P | S | Mo |
| 1 | CrC | 66.5 | 33.5 | — | 0.16 | 2.82 | 41.77 | 27.52 | 0 | 6.28 | 0.74 | 1.75 | 12.55 | 6.4 |
| C1 | CrN | 62.4 | — | 37.6 | 11.28 | 11.28 | 44.1 | 29.39 | 6.94 | 2.39 | 2.13 | 2.74 | 0.82 | 0.01 |
| C2 | Cr plating | 100 | — | — | | | | | | — | | | | |
| C3 | Carburized material | | — | | 1 | 0 | 50.92 | 30.9 | 0.48 | 5.01 | 2.55 | 5.71 | 3.25 | 0.17 |

TABLE 2

| Additive amount of | Components of compounded oil (the balance: base oil) (ppm) | | | | | | | | |
|---|---|---|---|---|---|---|---|---|---|
| Mo-trinuclear | Mo | S | Zn | P | N | B | Ca | Na | Si |
| 80 ppm | 80 | 2400 | 700 | 630 | 500 | 16 | 2000 | 0 | 4 |

7. The sliding system as recited in claim 5, wherein the lubricant oil contains the trinuclear Mo compound with a mass ratio of Mo to the lubricant oil as a whole of 25-900 ppm.

8. The sliding system as recited in claim 5, wherein $MoS_2$ is generated on the coating surface during sliding.

* * * * *